US012310442B1

(12) United States Patent
Carre et al.

(10) Patent No.: US 12,310,442 B1
(45) Date of Patent: May 27, 2025

(54) HAT WITH DETACHABLE LINER

(71) Applicant: YO LA HATS LLC, Middletown, DE (US)

(72) Inventors: Haley Carre, Brooklyn, NY (US); Abigail Lierheimer, Fort Collins, CO (US)

(73) Assignee: YO LA HATS LLC, Middletown, DE (US)

( * ) Notice: Subject to any disclaimer, the term of this patent is extended or adjusted under 35 U.S.C. 154(b) by 0 days.

(21) Appl. No.: 18/767,506

(22) Filed: Jul. 9, 2024

(51) Int. Cl.

| | |
|---|---|
| ***A42B 1/004*** | (2021.01) |
| ***A42B 1/205*** | (2021.01) |
| ***A42B 7/00*** | (2006.01) |
| ***A44C 11/00*** | (2006.01) |

(52) U.S. Cl.
CPC ..... *A42B 1/205* (2013.01); *A42B 1/004* (2013.01); *A42B 7/00* (2013.01); *A44C 11/00* (2013.01)

(58) Field of Classification Search
CPC . A44C 15/0045; A44C 15/006; A42B 1/0189; A42B 7/00; A42B 1/045; A42B 1/004; A42B 1/019; A42C 5/00; A42C 5/02; A42C 5/04
See application file for complete search history.

(56) References Cited

U.S. PATENT DOCUMENTS

| | | | | |
|---|---|---|---|---|
| 365,115 A | | 6/1887 | Bigney | |
| D25,987 S | | 9/1896 | Plumley | |
| 2,263,395 A | * | 11/1941 | Page | A42C 5/02 2/181 |
| D153,778 S | | 5/1949 | Feldman | |
| D166,366 S | | 4/1952 | Todd | |
| 4,551,860 A | * | 11/1985 | Smit | A42C 5/04 2/200.1 |
| 4,941,210 A | * | 7/1990 | Konucik | A41D 27/13 2/195.3 |
| D403,491 S | | 1/1999 | Wyatt et al. | |
| 5,887,284 A | * | 3/1999 | Simmons | A42C 5/02 2/184 |

(Continued)

OTHER PUBLICATIONS

Babywantsbling Swarovski Crystal Rhinestone Double Chain Black Bling Ladies Fashion Cap Hat, announced May 24, 2012 [online], [site visited Jul. 26, 2024]. Available from internet, URL: (Year: 2012).

(Continued)

*Primary Examiner* — Katherine M Moran
(74) *Attorney, Agent, or Firm* — INNOVATION CAPITAL LAW GROUP, LLP; Vic Lin

(57) ABSTRACT

A hat includes a crown. A band is positioned on a bottom, interior edge of the crown. Female snaps are positioned on the band. A multi-layered, detachable liner including a set of male snaps, is attached to the band via a mating to the female snaps. A detachable liner comprises an organic cotton facing outward from the interior edge of the crown and disposed to contact a forehead of a user wearing the hat, a second layer of canvas support backing the first layer, and a third layer terry cloth positioned between the first layer and the second layer, disposed to absorb sweat from the forehead, through the first layer. Grommets are positioned on the crown with a hole passing through a fabric of the crown. A chain is secured to the grommets and configured to lay across the brim or bill.

16 Claims, 12 Drawing Sheets

(56) References Cited

U.S. PATENT DOCUMENTS

| | | | | |
|---|---|---|---|---|
| 6,655,558 | B2 | 12/2003 | Lawrence | |
| 6,836,901 | B2 * | 1/2005 | Hippensteel | A42C 5/02 2/60 |
| 8,001,624 | B1 | 8/2011 | Leedom | |
| 8,065,751 | B2 * | 11/2011 | Chen | A42C 5/02 57/208 |
| 10,264,838 | B2 * | 4/2019 | Quiroz | A42B 1/24 |
| 10,271,607 | B2 * | 4/2019 | Hickey | A42B 1/22 |
| D897,072 | S | 9/2020 | Eldridge et al. | |
| 11,191,317 | B2 * | 12/2021 | Soibelman | A42C 5/02 |
| 11,224,260 | B2 | 1/2022 | Inouye | |
| 11,819,083 | B2 * | 11/2023 | Gilbert | A42C 5/02 |
| 2002/0108165 | A1 * | 8/2002 | Porter | A42B 1/24 2/209.13 |
| 2004/0026468 | A1 | 2/2004 | Lawrence | |
| 2010/0107307 | A1 | 5/2010 | Lee | |
| 2011/0119805 | A1 * | 5/2011 | Slarve | A42B 1/24 2/209.13 |
| 2012/0030860 | A1 * | 2/2012 | Lovitz | A42B 1/004 2/209.13 |
| 2016/0128418 | A1 | 5/2016 | Steele et al. | |
| 2017/0202294 | A1 * | 7/2017 | Hickey | A42B 7/00 |
| 2018/0146734 | A1 | 5/2018 | Kelly | |
| 2019/0183201 | A1 * | 6/2019 | Defino | A42B 1/248 |
| 2019/0297982 | A1 * | 10/2019 | Denny | A42B 1/004 |
| 2022/0408888 | A1 * | 12/2022 | Nason | A44C 15/006 |
| 2023/0087795 | A1 * | 3/2023 | Shwartz | A42B 1/0182 2/195.6 |
| 2023/0292869 | A1 * | 9/2023 | Sampson | A42B 1/019 2/171 |

OTHER PUBLICATIONS

Hatland SF Giants 'Chain Snapback' Black Hat by New Era, announced Dec. 12, 2016 [online], [site visited Jul. 26, 2024]. Available from internet, URL: (Year: 2016).

Henwasai 3PCS Trucket Hat Chains, announced Apr. 10, 2024, [online], [site visited Jul. 26, 2024]. Available from internet, URL: (Year: 2024).

I Design 3 Pcs Trucket Hat Chains, announced May 30, 2024 [online], [site visited Jul. 26, 2024]. Available from internet, URL: (Year: 2024)

Style Shark Chain Cabbie Hat, Announced Nov. 17, 2019 [online], [site visited Jul. 26, 2024]. Available from internet, URL: (Year: 2019).

Amazon Disposable Hat Liner, https://www.amazon.com/Absorbent-Disposable-Self-Adhesive-Hat-Liners/dp/B0887VQ6P7, 2020.

Amazon Hat Sweat Liner, https://www.amazon.com/Absorbent-Protector-Disposable-Sweatband-Preservation/dp/B09X363XHV, 2022.

Amazon Hat Sweat Liner, https://www.amazon.com/HatDefender-Hat-Sweat-Liner-Waterproof/dp/B09XN6R41B, 2022.

Etsy, https://www.etsy.com/listing/1473163468/custom-trucker-hat-accessory-charm, 2023.

Faire, https://www.faire.com/discover/trucker-hat-charms, 2024.

Lulu Lemon, https://shop.lululemon.com/p/hats/Removable-SweatbAll-Sport-Visor/_/prod11020309, 2023.

NoSweat Sweat Liners, (2023) https://nosweatco.com/products/white-hat-liners?variant=43139344269503.

Trucker Hat Bill Chain Accessory, https://www.amazon.com/Trucker-Accessory-Detachable-Necklace-Assorted/dp/B0CVMD6R6B?th=1, 2024.

* cited by examiner

HAT WITH DETACHABLE LINER

CROSS-REFERENCE TO RELATED APPLICATIONS

None.

FIELD

The subject disclosure relates to apparel, and more particularly, to a hat with detachable liner.

BACKGROUND

Conventional head worn apparel is known to cause hat build-up and sweating amongst users. Conventional hats have long included a sweatband to prevent sweat from dripping down the front of the face and sides of the head. The conventional sweatband is sewn into the crown. Sweat combined with dirt and other bacteria are known to become trapped by the sweatband. When a user is done wearing a hat for a session of use, the sweat, dirt, and bacteria dry onto and into the sweatband. Repeated uses of the hat create layers of dried sweat, dirt, and bacteria that build-up over time. Over time, the hat can be come unhygienic and even smell from repeated use.

SUMMARY

In one aspect of the disclosure, a hat is disclosed. The hat includes a crown. A band is positioned on a bottom, interior edge of the crown. One or more fasteners are positioned on the band. A multi-layered, detachable liner is attached to the band via the one or more fasteners. A first layer of the liner comprises an organic cotton facing outward from the interior edge of the crown.

In another aspect of the disclosure, a hat is disclosed. The hat includes a crown. One or more grommets are positioned on the crown with a hole passing through a fabric of the crown. A chain including an end is secured to the one or more grommets.

In still yet another aspect of the disclosure, a hat is disclosed. The hat includes a crown. A bill or brim is coupled to the crown. A band is positioned on a bottom, interior edge of the crown. One or more female snaps are positioned on the band. A multi-layered, detachable liner including a set of male snaps, is attached to the band via a mating of the female snaps to the set of male snaps. A first layer of the liner comprises an organic cotton facing outward from the interior edge of the crown and disposed to contact a forehead of a user wearing the hat. A second layer of the liner comprises a canvas support backing of the first layer. A third layer of the liner comprises a terry cloth positioned between the first layer and the second layer, and disposed to absorb sweat from the forehead, through the first layer. One or more grommets are positioned on the crown with a hole passing through a fabric of the crown. A chain including ends is secured to the one or more grommets and configured to lay across the brim or bill when secured to the one or more grommets.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION OF THE PREFERRED EMBODIMENTS

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

Overview

In general, and referring to the figures, embodiments disclose a hat 100 with a detachable liner 150 (which will be shown and described in more detail in FIGS. 6, 9A, 9B, 9C, and 10), that provides an improvement in the hygienic wear of head-worn apparel. The detachable liner 150 can be removed after wear, washed, and re-attached so that bacteria, sweat, grime, and other skin contaminants are removed, preventing conditions such as acne. The skin of many users is sensitive to conditions that promote acne. Closed-top hats in particular tend to promote an environment where sweat and oil build-up on the interior of the hat because the majority of the head is covered. Dandruff and dirt on the skin get trapped by the sweat and oil which causes acne-prone skin to break out along areas where the skin contacts elements of a hat. A user's forehead may be especially prone to an outbreak of acne since the material of a hat directly contacts a large swath of skin. Being at the forefront of one's face, acne can become especially prevalent after a hat is worn. The conventional approach to remedying the problem of sweat build-up is to wash the entire hat. However, hats are not designed to be washed since they use fabric materials that are shaped. Washing a hat loses or ruin the shape of the crown and/or bill (for example, parts of the hat wrinkle or the crown deflates). The hat 100 provides anti-acne protection through the inclusion of the detachable liner 150 that promotes cleaning of the sweatband area while retaining the structural integrity of a hat. In addition, other elements of the hat 100 provide users with customizability so that the hat 100 can be worn with different appearances between uses.

Figure 1:
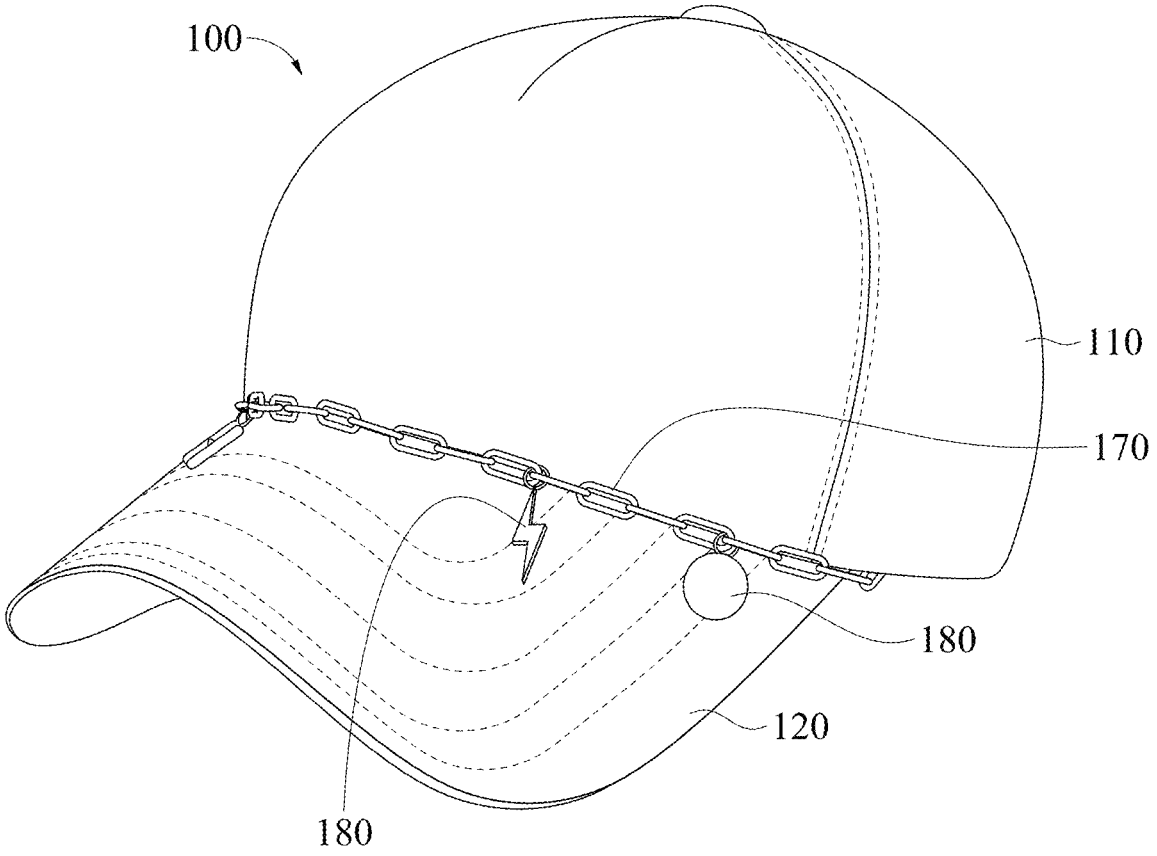
FIG. 1 is a front, perspective view of a hat, according to an exemplary embodiment.
Figure 2:
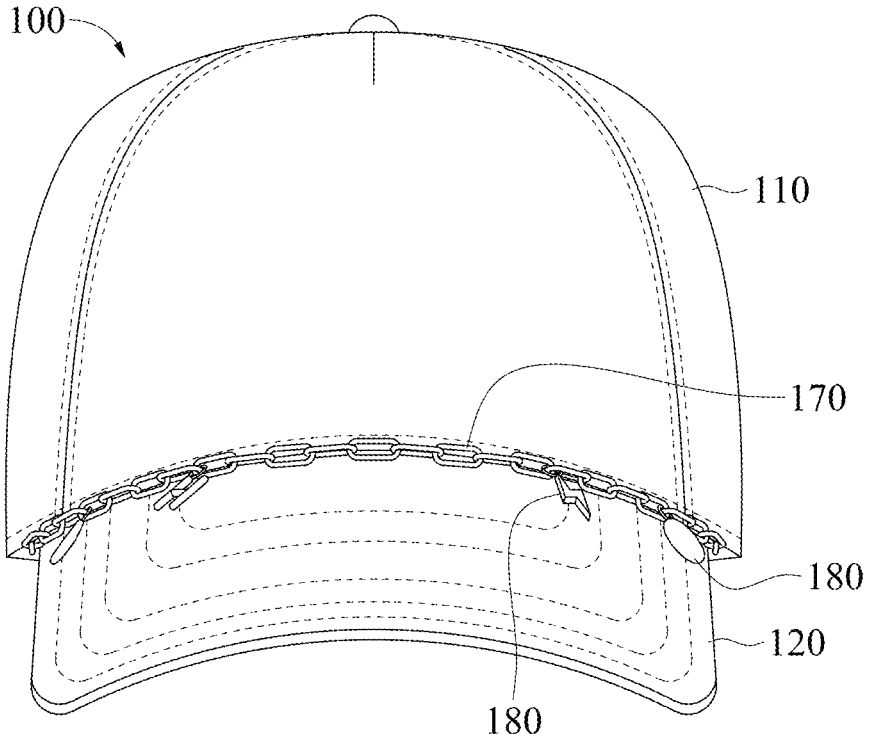
FIG. 2 is a front view of the hat of FIG. 1.
Figure 3:
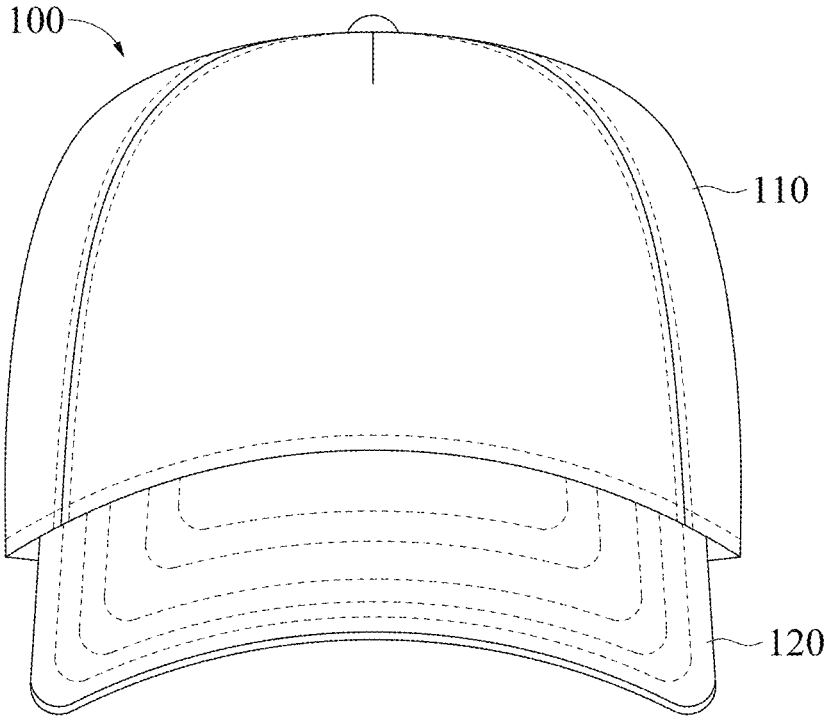
FIG. 3 is a front view of the hat of FIG. 1, sans a chain.

Referring now to FIGS. 1 and 2, the hat 100 is shown according to an embodiment that includes a customizable element. In general, the hat 100 may comprise a substantially closed-top article, with a crown 110 that covers more than 50% of the surface area of a user's head. While a baseball cap style hat is shown, it should be understood that other styles of hats may incorporate the novel aspects of the hat 100. The hat 100 may include a bill or brim 120. The hat 100 may include a chain 170 that may be removably coupled to the crown 110 or brim 120. The chain 170 may include one or more detachable interchangeable charms 180. Details of the chain's coupling are discussed in detail below with respect to FIGS. 13, 14A, and 14B.

Figure 4:
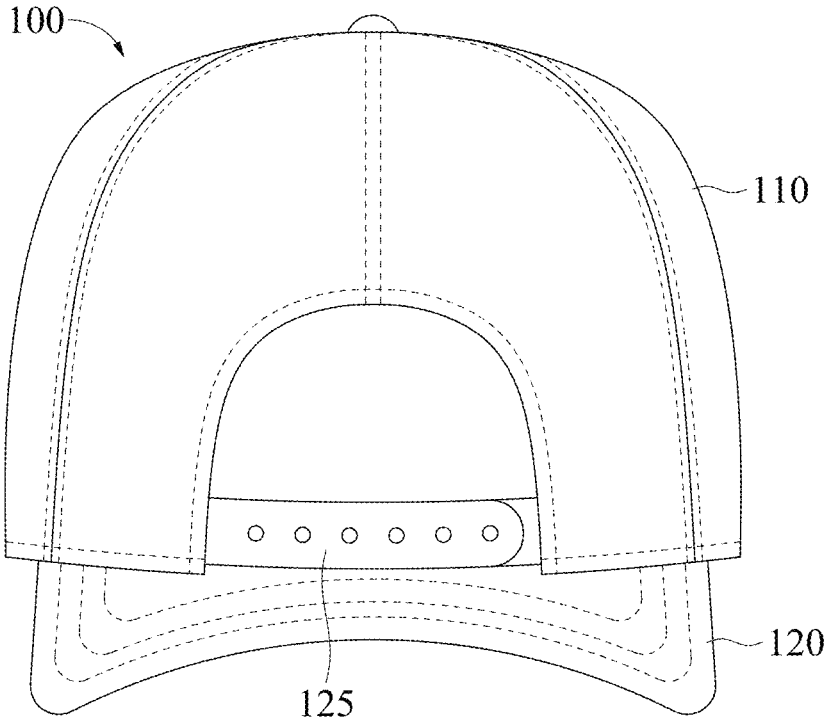
FIG. 4 is a rear view of the hat of FIG. 3.
Figure 5:
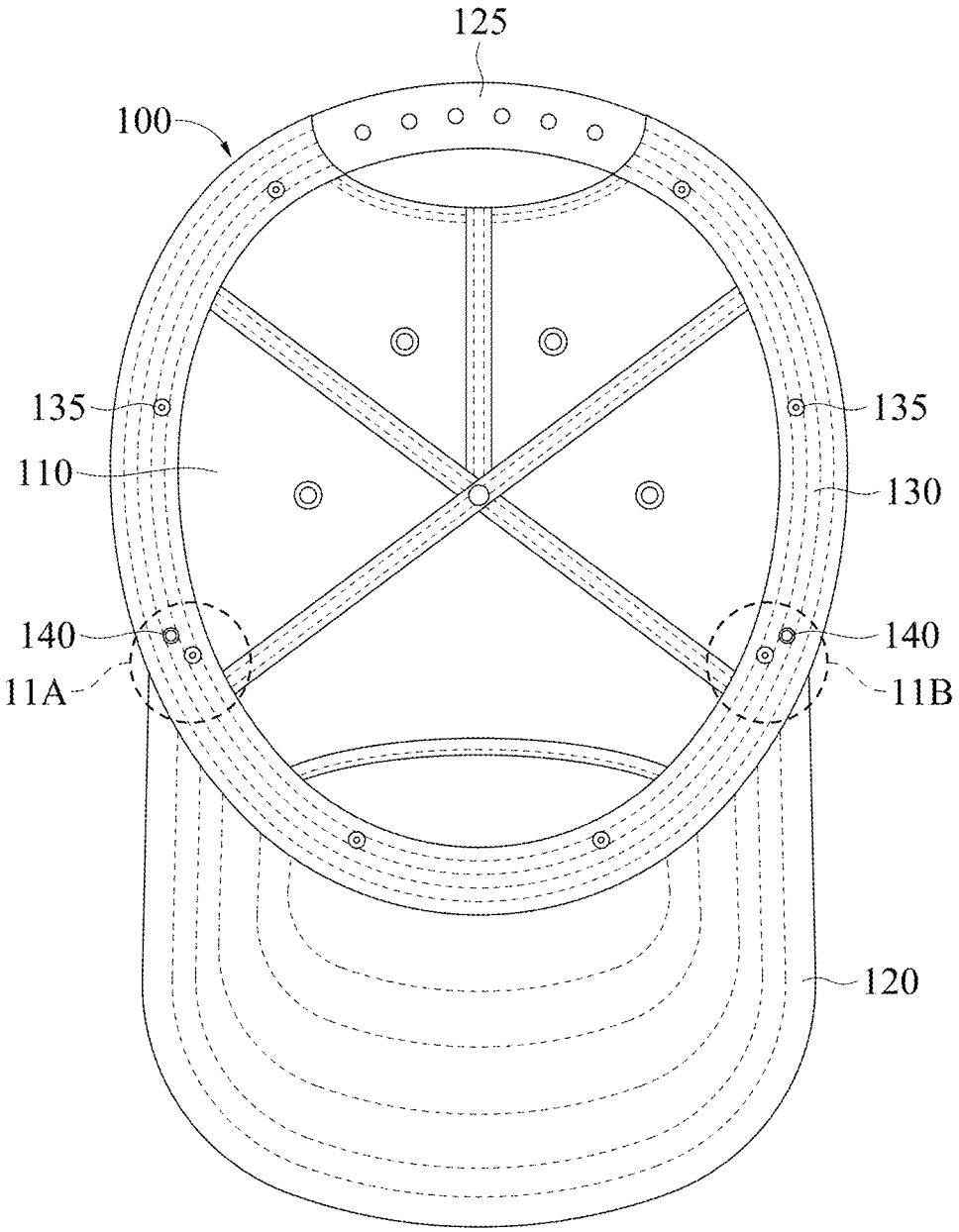
FIG. 5 is a bottom view of the hat of FIG. 3.
Figure 6:
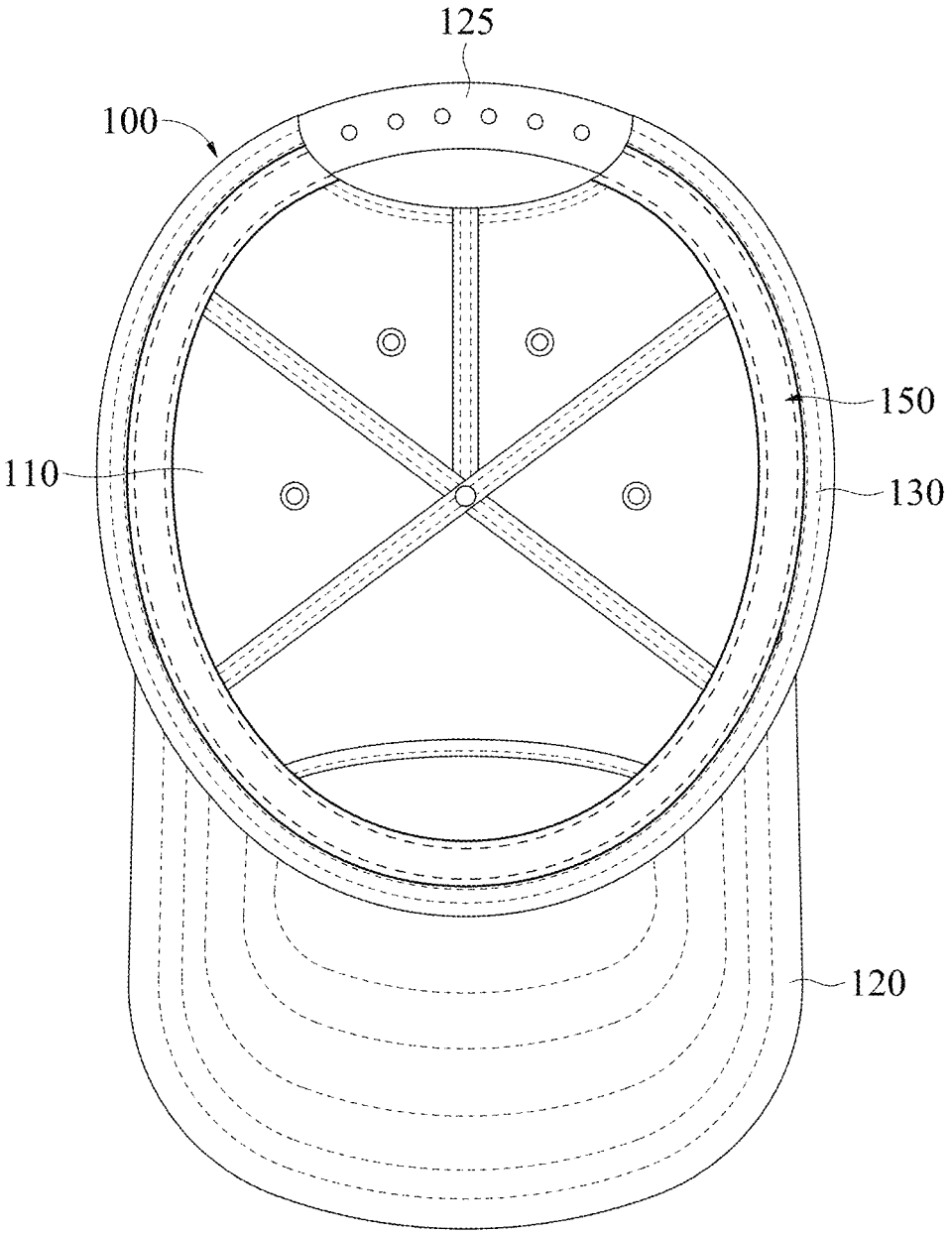
FIG. 6 is a bottom view of the hat of FIG. 5, with a detachable liner attached to the band, consistent with embodiments.
Figure 7:
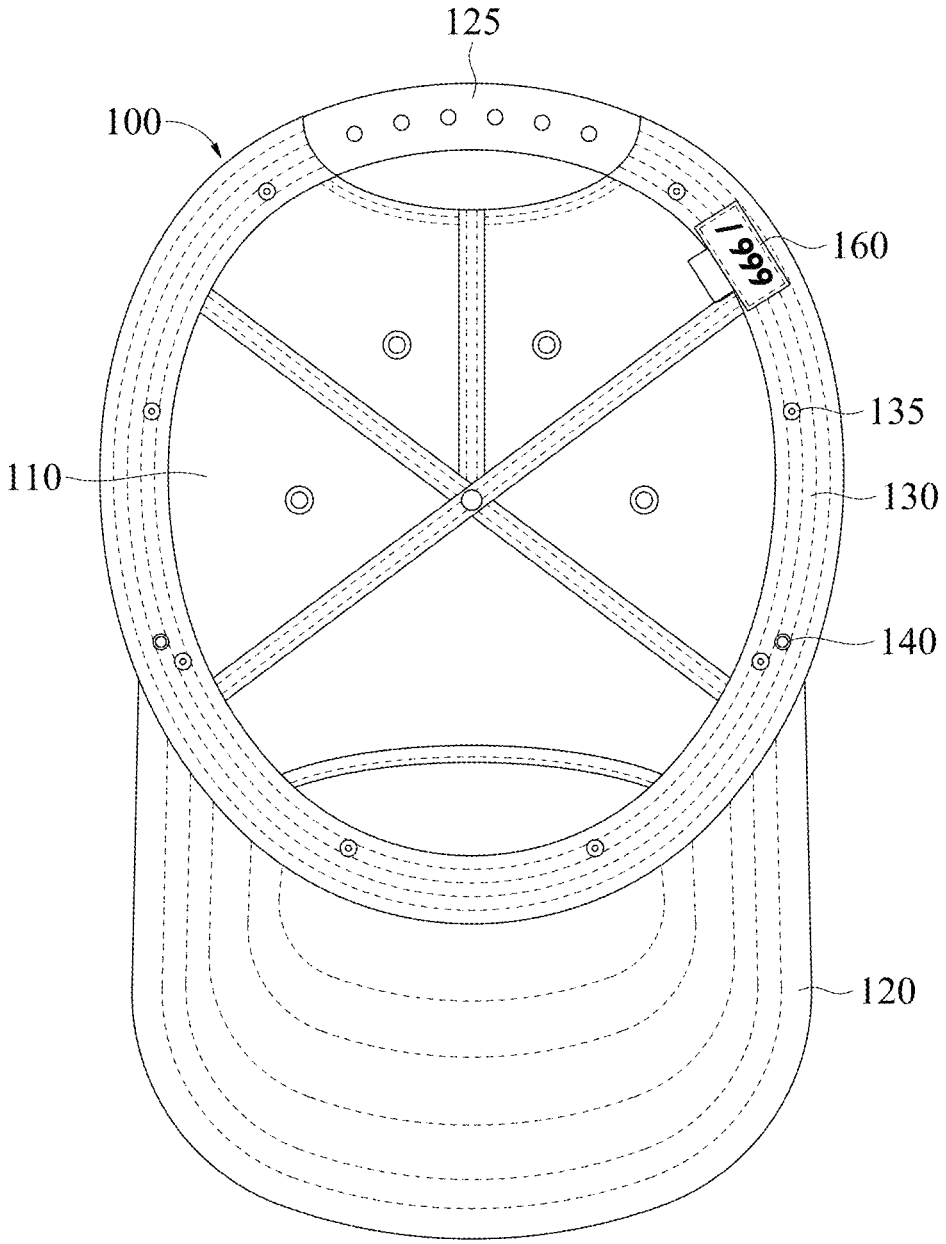
FIG. 7 is a bottom view of the hat of FIG. 3, according to another embodiment.
Figure 8:
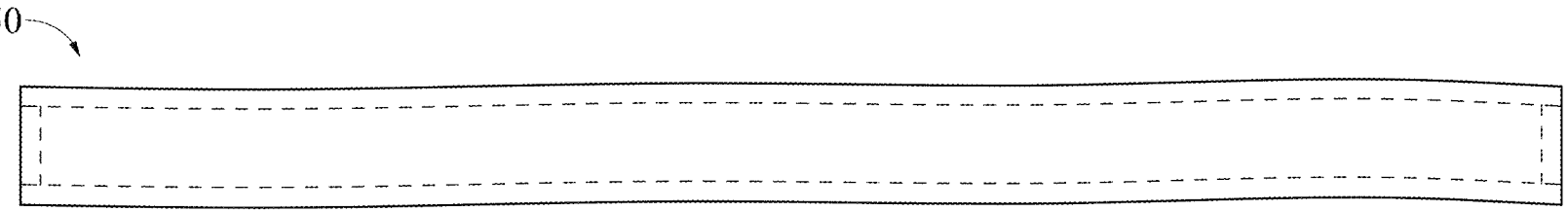
FIG. 8 is an isolated view of the detachable liner of FIG. 6.
Figure 9A:
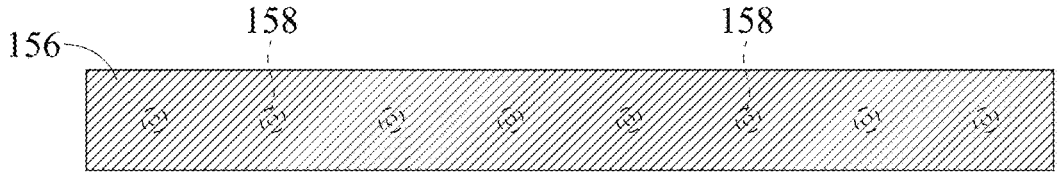
FIG. 9A is an isolated view of a layer of the detachable liner of FIG. 8.
Figure 9B:
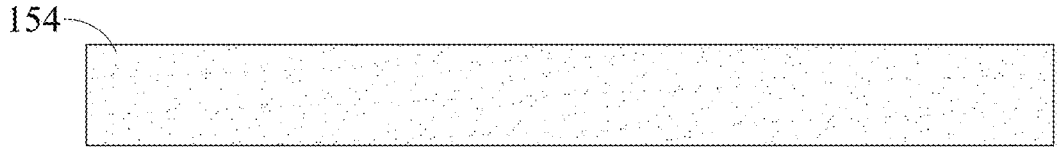
FIG. 9B is an isolated view of a layer of the detachable liner of FIG. 8.
Figure 9C:
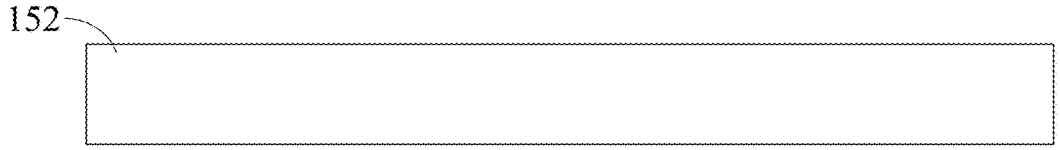
FIG. 9C is an isolated view of a layer of the detachable liner of FIG. 8.
Figure 10:
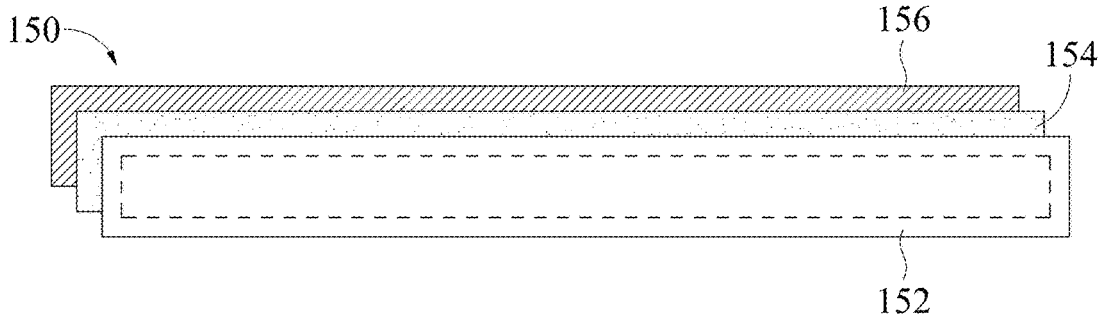
FIG. 10 is an exploded perspective, front view of the layers of the detachable liner of FIG. 8.
Figure 11B:
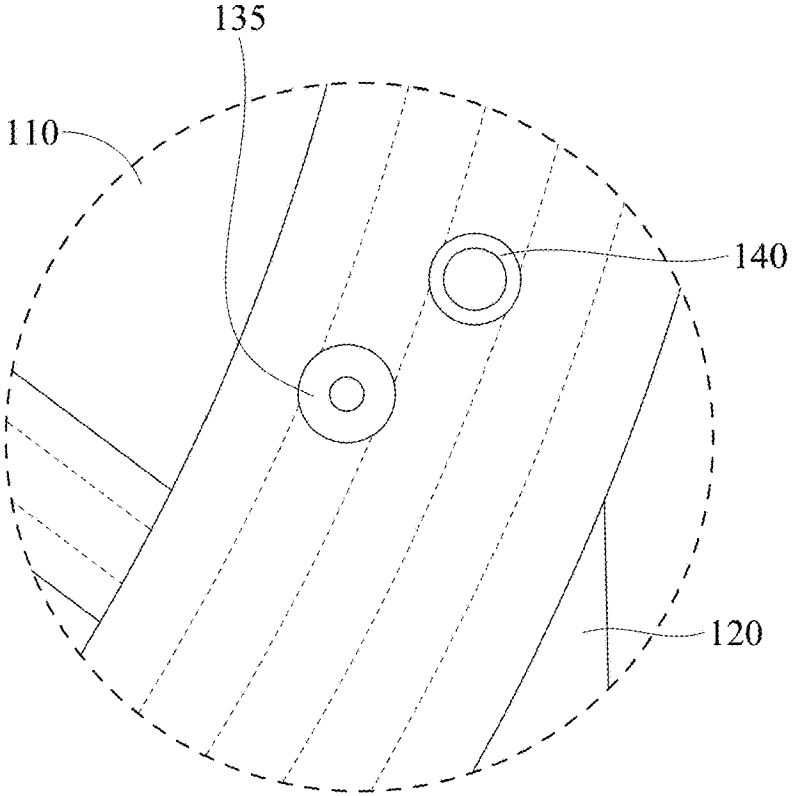
FIG. 11B is an enlarged view of the circle "11B" shown in FIG. 5.
Figure 11A:
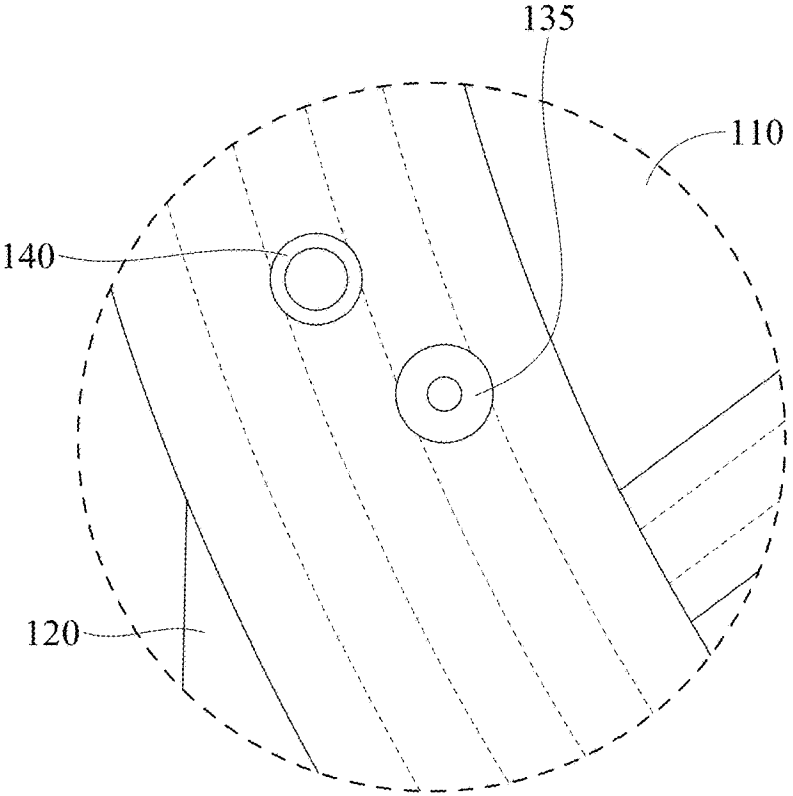
FIG. 11A is an enlarged view of the circle "11A" shown in FIG. 5.

Referring now to FIGS. 3-7, the hat 100 is shown without the chain 170. As shown in FIG. 4, a preferred embodiment of the hat 100 may include a snap-back fastener 125 on the rear of the crown 110. Snap-back embodiments may include a partial opening in the rear of the crown 110, but otherwise still cover a substantial surface area of a user's head. It should be understood that while a snap-back style is shown, embodiments may cover other styles of crowns 110 including adjustable belt style closings, stretch-worn closings, and fitted crowns. As shown in FIG. 5, the hat 100 may include a band 130 positioned on a bottom, interior edge of the crown 110. A plurality of fasteners 135 (for example, female snaps) may be positioned along the circumference of the band 130. One or more grommets 140 may be integrated into the band 130 so that a hole passes through the fabric of the band 130 and crown 110. The grommets 140 may be positioned proximate the front of the crown 110, adjacent an intersection with the bill or brim 120; for example, forward of a centerline line that cuts across the top center of the crown 110 from left to right. FIG. 7 shows an embodiment similar to FIG. 6 except that some embodiments may include additional articles 160 attached to the band 130 (for example, a logo tag).

Detachable Liner

Referring now to FIG. 6, the hat 100 is shown with the detachable liner 150 attached over the band 130. It should be noted that a peek of the underlying band 130 is shown for illustrative purposes, but embodiments will generally cover the band 130 with the detachable liner 150 so that material from the band 130 is not exposed to the user's skin. In embodiments that use fitted crowns 110, the detachable liner 150 may extend all the way around the bottom edge of the crown 110. As may be appreciated, the detachable liner 150 may also prevent acne all around the circumference of the user's head (not just the forehead), which may be helpful for user's who are bald, wear their hair tight (very short) to the skin, or who have oily hair when wearing caps that breaks out under the hair.

Referring now to FIGS. 8, 9A-9B, 9C, and 10, the detachable liner 150 is shown separated from the band 130. The detachable liner 150 may be multi-layered. In one embodiment, the detachable liner 150 includes a first layer 152 of organic cotton facing outward from the interior edge of the crown 110, disposed to contact a forehead of a user wearing the hat 100. The organic cotton provides a layer of comfort while simultaneously resisting bacterial growth, and acne growth in general. Contaminants are also easy to wash from the organic cotton making its use conducive to providing a clean surface for re-use of the hat 100. The first layer 152 may also comprise other fabrics including, but not limited to, silver infused cotton, antimicrobial fabrics and more. A second layer 156 of the liner 150 may comprise a canvas support backing of the first layer 152. The second layer 156 is disposed to be the innermost layer in contact with the body of the crown 110. As may be appreciated, canvas is durable and protects the fabric of the crown 110 from sweat permeation. A third layer 154 may be terry cloth positioned between the first layer 152 and the second layer 156. The terry cloth absorbs sweat from the forehead, through the first layer 152, drawing moisture away from the skin. The second layer 156 may include a set of fasteners 158 (for example, male snaps) aligned to couple with the fasteners 135 on the band 130. In the preferred embodiment, the detachable liner 150 may comprise male snaps that can be removably coupled to the female snaps 135 on the band 130. It is to be expressly understood that the liner fasteners 158 and band fasteners 135 may comprise a variety of connection mechanisms that can facilitate a removable connection. For example, such connection mechanisms may include hook-and-loop fasteners and more. When the fasteners 158 of the detachable liner 150 are coupled to the fasteners 135 on the band 130, the result is depicted in FIG. 6. After a user is done wearing the hat 100, the fasteners 158 may be decoupled from the fasteners 135 so that the liner 150 is removed from the crown 110. The liner 150 may be washed for repeated subsequent use that mitigates the outbreak of acne from a user's skin/head when re-attached to the band 130.

Customization

Figure 12:
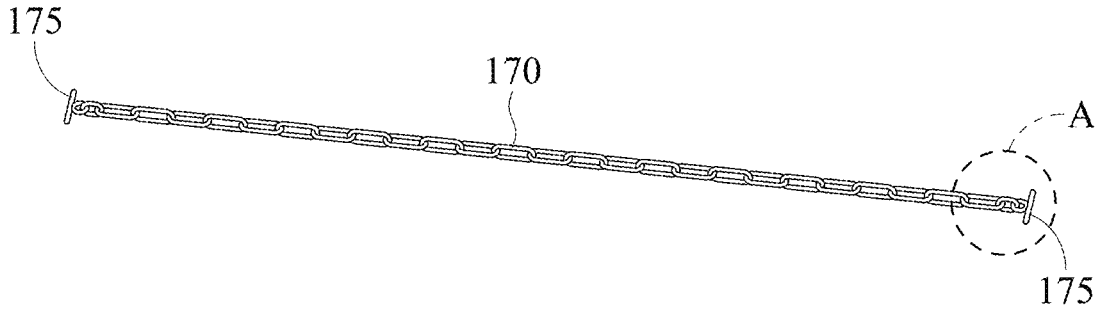
FIG. 12 is an isolated view of the chain from FIG. 1.
Figure 13:
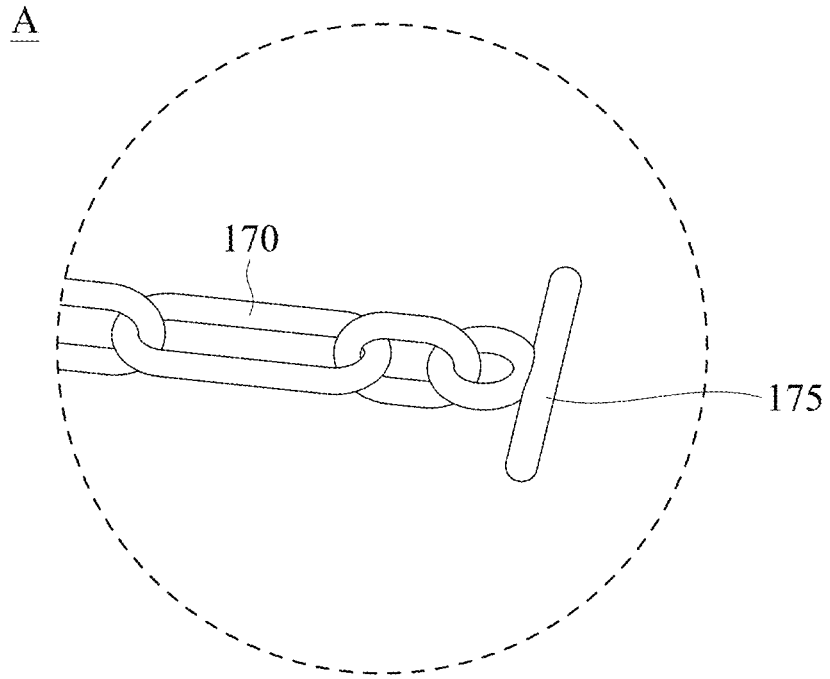
FIG. 13 is an enlarged view of the circle "A" from FIG. 12.
Figure 14A:
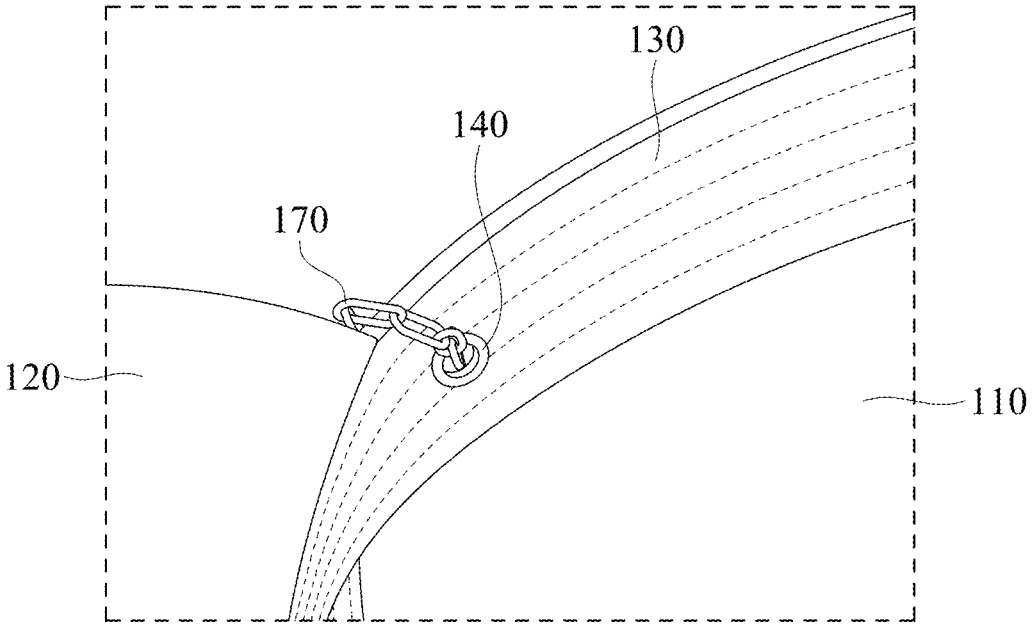
FIG. 14A is a perspective bottom view illustrating a connection of the chain through a grommet on the band, consistent with embodiments.
Figure 14B:
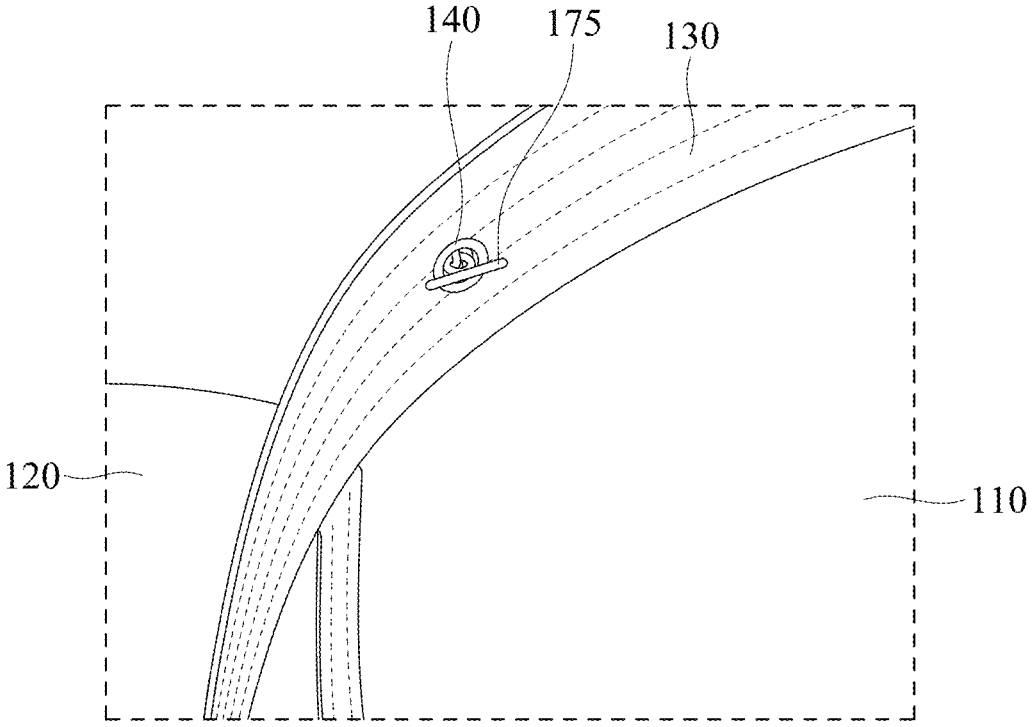
FIG. 14B is a perspective bottom view illustrating a connection of the chain through a grommet on the band, with the band inverted to show the underside of the band, consistent with embodiments.

Reference is now made to FIGS. 1-2 along with FIGS. 11A, 11B, 12-13, 14A, and 14B to discuss customization elements of the hat 100. The chain 170 is configured with aesthetic elements (charms 180) that are interchangeable. The chain 170 may be configured for quick connection and detachment from the crown 110. For example, as shown in FIGS. 12 and 13, the chain 170 may include a toggle 175 on one or both ends. The toggle(s) 175 may be slipped through the grommets 140 on the band 130 to secure the chain 170 onto the brim or bill 120. While the toggle 175 helps to secure the chain 170 to the crown 110, it should be noted that movement may position the ends of the toggles 175 in such a way that the toggles 175 may accidently slip back out of the grommets 140. However, it should be appreciated that the liner 150, when secured to the band 130, covers the toggles 175, simultaneously protecting the user from irritation potentially caused by the toggles 175 rubbing against the skin, and further securing the toggles 175 into place by inhibiting movement. While the foregoing embodiment was described using a chain 170 and a toggle 175, other embodiments may use other forms including beads instead of a chain and other end fasteners instead of toggles. Yet, the liner 150 still provides the dual role of protection to the user and securement of the aesthetic elements to the crown 110.

Definitions

Organic cotton, as used herein, refers to methods involving production of cotton without the use of chemical fertilizers, pesticides, or other artificial agents.

Terry cloth or terry fabric, as used herein, refers to a fabric woven with many protruding loops of thread which can absorb large amounts of water.

Canvas, as used herein, refers to a stiff material (as of coarse cloth) that has regular meshes.

Conclusions and Caveats

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense, it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A hat, comprising:

a crown;

a band positioned on a bottom, interior edge of the crown;

one or more fasteners positioned on the band;

a multi-layered, detachable liner attached to the band via the one or more fasteners, wherein a first layer of the liner comprises an organic cotton facing outward from the interior edge of the crown;

one or more grommets in the band;

a brim or bill coupled to a bottom edge of the crown; and a chain laying across the brim or bill, including ends wrapped under the bottom edge of the crown and secured through the one or more grommets wherein the ends are covered by the multi-layered, detachable liner.

2. The hat of claim 1, wherein a second layer of the liner comprises canvas, facing inward toward the interior edge of the crown.

3. The hat of claim 2, wherein a third layer of the liner comprises terry fabric positioned between the organic cotton and the canvas.

4. The hat of claim 1, wherein the one or more fasteners on the band are female snaps and the liner further comprises male snaps aligned to mate to the female snaps.

5. The hat of claim 1, further comprising a snapback closure on a rear of the crown.

6. The hat of claim 1, wherein the chain is removable from the detachable liner.

7. A hat, comprising:

a crown;

a brim or bill coupled to a bottom edge of the crown;

a band positioned on a bottom, interior edge of the crown;

one or more grommets positioned on the band; and a chain laying across the brim or bill including a toggle end wrapped under the bottom edge of the crown and secured through one of the one or more grommets.

8. The hat of claim 7, wherein the chain is detachable from the crown.

9. The hat of claim 7, further comprising:

one or more fasteners positioned on the band; and a detachable liner attached to the band via the one or more fasteners.

10. The hat of claim 9, wherein fabric of the crown is configured to cover a top of a user's head.

11. The hat of claim 9, wherein the liner includes:

a first layer disposed for contact with a user's forehead;

a second layer disposed to provide support to the first layer; and a third layer positioned in between the first layer and the second layer, wherein the third layer is configured to absorb sweat from a user's forehead through the first layer.

12. The hat of claim 9, further comprising a snapback closure on a rear of the crown.

13. The hat of claim 9, wherein the one or more fasteners on the band are female snaps.

14. The hat of claim 13, further comprising a set of male snaps on the liner, aligned to mate to the female snaps on the band.

15. A hat comprising:

a crown;

a bill or brim coupled to the crown;

a band positioned on a bottom, interior edge of the crown;

one or more female snaps positioned on the band; and a multi-layered, detachable liner including a set of male snaps, attached to the band via a mating of the female snaps to the set of male snaps, wherein:

a first layer of the liner comprises an organic cotton facing outward from the interior edge of the crown and disposed to contact a forehead of a user wearing the hat, a second layer of the liner comprises a canvas support backing of the first layer, and a third layer of the liner comprises a terry cloth positioned between the first layer and the second layer, and configured to absorb sweat from the forehead, through the first layer;

one or more grommets positioned on the band with a hole passing through the band; and a chain laying across the brim or bill and including toggle ends wrapped under the bottom, interior edge of the crown and secured through the one or more grommets wherein the toggle ends are covered by the multi-layered, detachable liner.

16. The hat of claim 15, wherein the toggle ends of the chain are removable from the detachable liner.

* * * * *